US005857769A

United States Patent [19]

Beggs

[11] Patent Number: 5,857,769

[45] Date of Patent: Jan. 12, 1999

[54] CONDENSATION DIVERSION SYSTEM IN A LAMP FIXTURE

[76] Inventor: William C. Beggs, 4110 Shawnee La. NE., Atlanta, Ga. 30319

[21] Appl. No.: 886,779

[22] Filed: Jul. 1, 1997

Related U.S. Application Data

[60] Provisional application No. 60/021,548 Jul. 11, 1996.

[51] Int. Cl. [6] ..... F21V 33/00

[52] U.S. Cl. ..... 362/294; 362/96; 362/431

[58] Field of Search ..... 362/276, 294, 362/311, 339, 340, 373, 396, 431, 96

[56] References Cited

U.S. PATENT DOCUMENTS 1,415,685 5/1922 O'Neil ..... 362/311

2,773,171 12/1956 Pennow ..... 362/431

2,907,870 10/1959 Calmes ..... 362/294

*Primary Examiner*—Y My Quach

*Attorney, Agent, or Firm*—Lee, Mann, Smith, McWilliams, Sweeney & Ohlson

[57] ABSTRACT

A lamp fixture is disclosed having a construction which permits a dome above a light source to drain the condensate which forms on its inside surfaces to drip areas along the lower portions of the sides of the dome which are beyond the reach of the light source or its electrical components. The condensate drops from the drip areas onto the inside surfaces of a lamp fixture lens disposed beneath the dome, runs down the inside surfaces of the lens, and issues through weep holes through the lower extremities of the sides of the lens onto a horizontally disposed surface outside the lens. The condensate evaporates from or drips away from the horizontally disposed surface.

13 Claims, 2 Drawing Sheets

CONDENSATION DIVERSION SYSTEM IN A LAMP FIXTURE

This is a nonprovisional application which claims the filing date of the same applicant's provisional application Ser. No. 60/021,548 filed in the U.S. Patent and Trademark Office on Jul. 11, 1996.

This invention relates to a lamp housing having means to dispose of condensation collected inside the housing. More particularly it relates to a lamp housing constructed to transfer liquid collected inside the housing, where it might come in contact with and affect the operation of the electrical elements leading to the lamp assembly, to the outside of the housing where it may evaporate or drip harmlessly away.

The novel lamp housing disclosed herein is an improvement upon the housing disclosed in U.S. Pat. No. 4,486,691 issued Dec. 4, 1984, and the United States patents related thereto, U.S. Pat. Nos. 4,593,345; 4,745,343; and 4,849,622, but, as will be seen hereinafter, may be adapted to other lamp housings having a cap disposed upon a lens surrounding an emitter such as a flash tube or incandescent bulb. The present invention may also be adapted to disposing of condensation from inside other housings where a collection of condensation might interfere with electrical connections to an operating device within the housing. An infrared receiver is an example.

In the present invention, a pot is provided at the base of the lamp fixture, and the electrical elements are collected there which receive electrical current from an outside source and process that current for operating a lamp connected thereto. The electrical elements are disposed in the pot, arranged in a column or other convenient clump resting on the bottom of the pot and extending upwardly if necessary above the level of the base pot's rim. The pot is covered by a moisture impervious collar having a flange portion which extends outwardly to all portions of the rim. Approximately in the center of the collar a neck is formed which is unitary with the flange, or at least in sealing engagement with it, and extends upwardly from the plane of the flange. The upper end of the neck forms an orifice through which a lamp or similar electrical device is connected to the electrical elements disposed within the pot.

A lens which is preferably shaped like an inverted, truncated cone is placed over the lamp and upright neck of the collar and seated with its smaller diameter base end resting on a gasket disposed on the flange adjacent the neck on the collar. The upper end of the lens, having a diameter greater than the base end, is embraced by a gasket on which a dome is placed to cover the lamp assembly. The dome is arched over the lamp assembly, and its depending sides rest upon the gasket on the upper end of the lens. The downward reaches of the dome meet the gasket on the upper end of the lens at points outside of the orifice at the upper end of the neck in the collar so that any condensation which collects on the inside of the dome will run down the inside surface of the dome and drip onto the inside surface of the frustoconical lens. When enough condensation flows to the small end of the lens adjacent the neck of the collar, into a trough formed by the lens and the neck of the collar, weep holes in the lens wall allow the condensation to flow out of the lens onto the upper face of the collar outside the lens. Once there, the condensation can either evaporate or run off the outer edge of the collar.

The collar is clamped onto the base pot, and the dome is clamped to the collar by rod-like J-shaped clamping members, as will be explained hereinafter. A sealed lamp fixture is thus provided which collects and diverts any accumulations of condensation occurring within the fixture and moves the excess of these accumulations outside of the fixture before they reach any of the electrical connections to and from the lamp.

As will be seen from the accompanying drawings and description, the following advantages and objects are achieved by this invention:

The collar provides a flange to clamp or otherwise fasten the lens assembly to the lower housing containing the electrical connections.

The collar provides a means to hold the lower ends of the fasteners whose upper ends are holding the dome above the lens, with the lens clamped between the dome and the collar.

The collar provides a means to baffle radiation from the lamp radiating toward lower portions of the lens, or radiation from lower angles outside the fixture when the fixture is a radiation receiver.

The collar, in cooperation with the lower portion of the lens, provides a means to collect the condensation from the inside of the dome and lens area and, through small holes in the lens at a level below the top of the collar, to divert that condensation to the outside of the fixture.

The collar provides a means to collect some of the heat from the lamp and to conduct that heat to the outside of the fixture. Some heat may be conducted from the outside of the fixture into the fixture to heat the interior of the fixture at other times.

The collar may be formed to position ("self jig") the lens into a fixed proximity to the collar.

The collar provides a means to disassemble the lens assembly by the end user so that the end user can replace a damaged lens conveniently with no special tools or cements.

The gasket below the lens and above the collar prevents the heat in the collar from damaging the lens.

The fasteners between the collar and the dome are electrically conductive as are the collar and the dome, so that when the collar is grounded, such as through the clamping ring holding it to the lower housing containing the electrical connections, the dome is directly grounded for personnel safety and for discharging static electricity charges in the nearby atmosphere, thus reducing the tendency for lighting strikes to form between the dome and a charged cloud.

Though the present collar is made of aluminum to provide heat tolerance, other materials may be used.

These and yet additional objects and features of the invention will become apparent from the following detailed discussion of exemplary embodiments, and from the drawings and appended claims.

BRIEF DESCRIPTION OF THE DRAWINGS

For a complete understanding of this invention, reference should be made to the accompanying drawings in which.

DETAILED DESCRIPTION OF THE PREFERRED EMBODIMENTS

Figure 1:
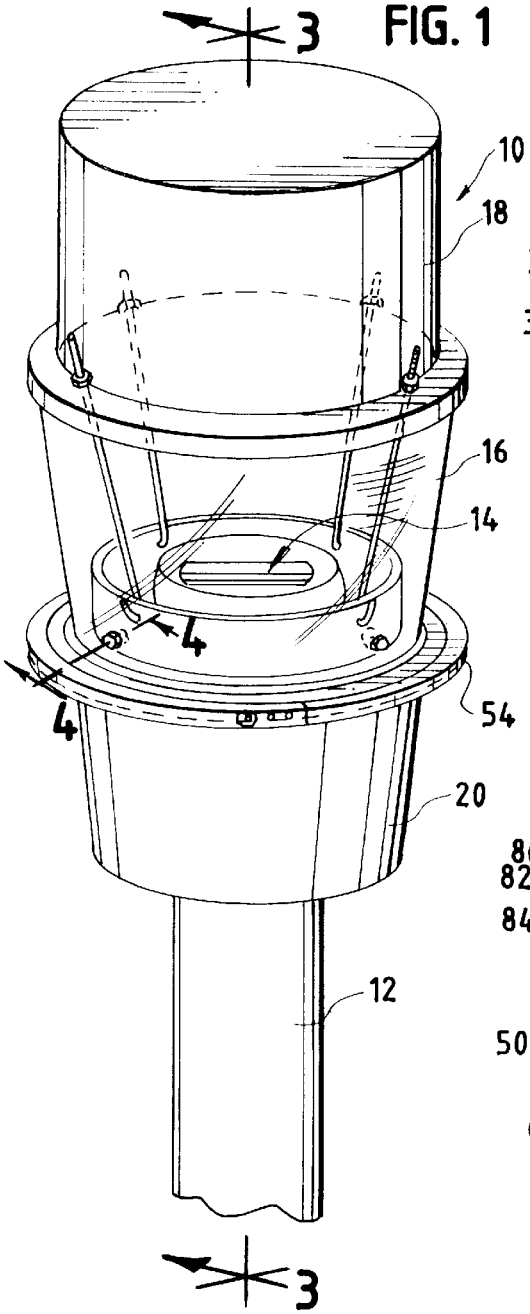
FIG. 1 is a perspective view of a panoramic light emitter incorporating the present invention mounted upon a vertical support member.

The lamp fixture 10 shown in FIG. 1 may be assembled and operated on an upright post 12 close to the ground, or the post 12 may assume another form such as a tower (not shown). A light source 14 is disposed inside a refractor such as lens 16 so that light from the light source may be transmitted through the lens into the far field. A heat-dissipating dome member 18 is disposed on the top end of lens 16. Below the lens, a pot such as canister 20, which contains the electrical connections from a source of electrical power (not shown) to which the light source 14 is connected, supports the lens 16 and the dome member 18 on the post 12. Alternatively, an electromagnetic radiation detecting member (not shown) may be substituted for the light source 14 and connected to means (not shown) in the canister for receiving output from the electromagnetic radiation detecting member.

The lens 16 has sloping sides 22 which extend upwardly and form inclined surfaces inside the lens. The sloping sides 22 extend from a lower end 24 of the lens having a smaller orifice 26 than the larger orifice 28 at the upper end 30 of the lens. A gasket 32 fits the larger orifice 28 at the upper end of the lens, and a second gasket 34 fits the smaller orifice 26 at the lower end of the lens. The dome member 18 is hat-shaped with a lower flange portion 36 arranged to overlie the upper edge of the lens formed at the larger orifice 28. Gasket 32 is interposed between flange 36 and the lens to seal the dome member and the lens together when the dome member is clamped onto the lens utilizing apertures 38 as will shortly be described.

Canister 20 is formed with a flange 40 extending outwardly from the side walls 42 of the canister. The outside edges 44 have a greater diameter than the lower end 24 of the lens. Inside the canister 20 there is a cavity 46 for receiving a clump of electrical connections 48 for supplying current to the light source 14.

A collar 50 is interposed between the lens 16 and the canister 20. Generally horizontally extending flange portion 52 of collar 50 is dimensioned to match flange 40 of the canister 20 so that the outer edges of the collar flange 52 and the canister flange 40 can be clamped together with a clamping ring 54. A neck portion 56 of the collar 50 is arranged to fit up into the lower end 24 of the lens and at the same time surround the light source 14 and adjacent portions of the clump of electrical connections 48 and wall them off from the sloping sides 22 of the lens and the flange 52 of the collar. Apertures 58 or functionally similar connective means are formed in the collar neck portion for engagement by electrically conductive clamping means 60 arranged to hold the collar 50 against the lower end 24 of the lens and the dome member 18 against the upper end 30 of the lens. In the particular embodiment which is shown, clamping means 60 is illustrated as a plurality of rod members having hooked lower ends 62 for engagement in apertures 58 and threaded upper ends 64 suitable for insertion through apertures 38 in the flange portion 36 of the dome member 18. The rods 60 are snubbed up on the flange 36 by tightening nuts 66 on the threaded ends 64. In this manner, the collar 50 is sealingly fastened against the lower end 24 of the lens.

Figure 2:
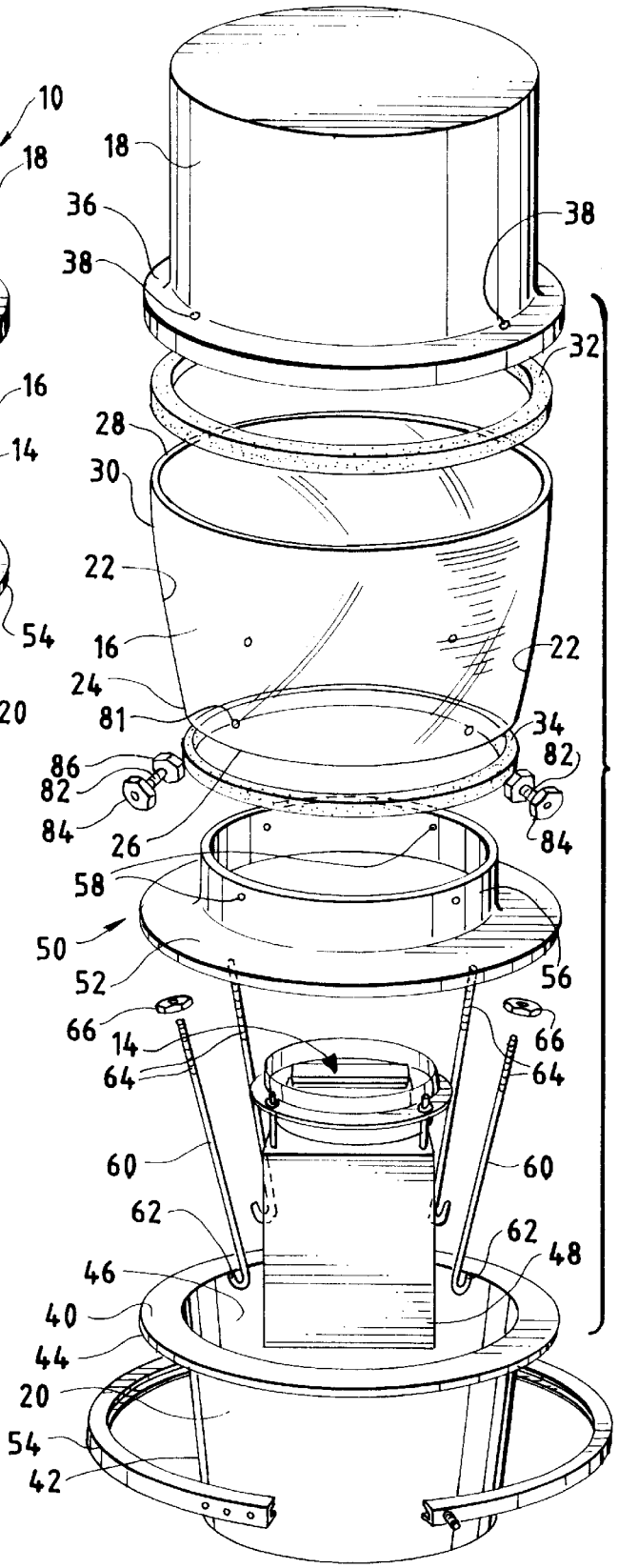
FIG. 2 is an exploded perspective view of the panoramic light emitter shown in FIG. 1.

Also, as illustrated in FIG. 2, for example, the electrically conductive clamping ring 54 is arranged to fit over both the outer extremities of flange 40 of the canister and of the flange portion 52 of the collar member, and when so assembled and clamped the canister 20 is securely fastened to the remainder of the lamp fixture assembly above it. Clamping ring 54 may also be observed clamping the flange 40 of the canister and the flange portion 52 of the collar member 50 together in FIG. 3.

There may be a gasket (not shown) between the flange 40 on the canister 20 and the bottom face of the flange portion 52 in order to accomplish a seal between the two flanges. Such a gasket not only seals the canister from the flange on the collar but also controls the transfer of heat from the collar down into the canister.

Figure 3:
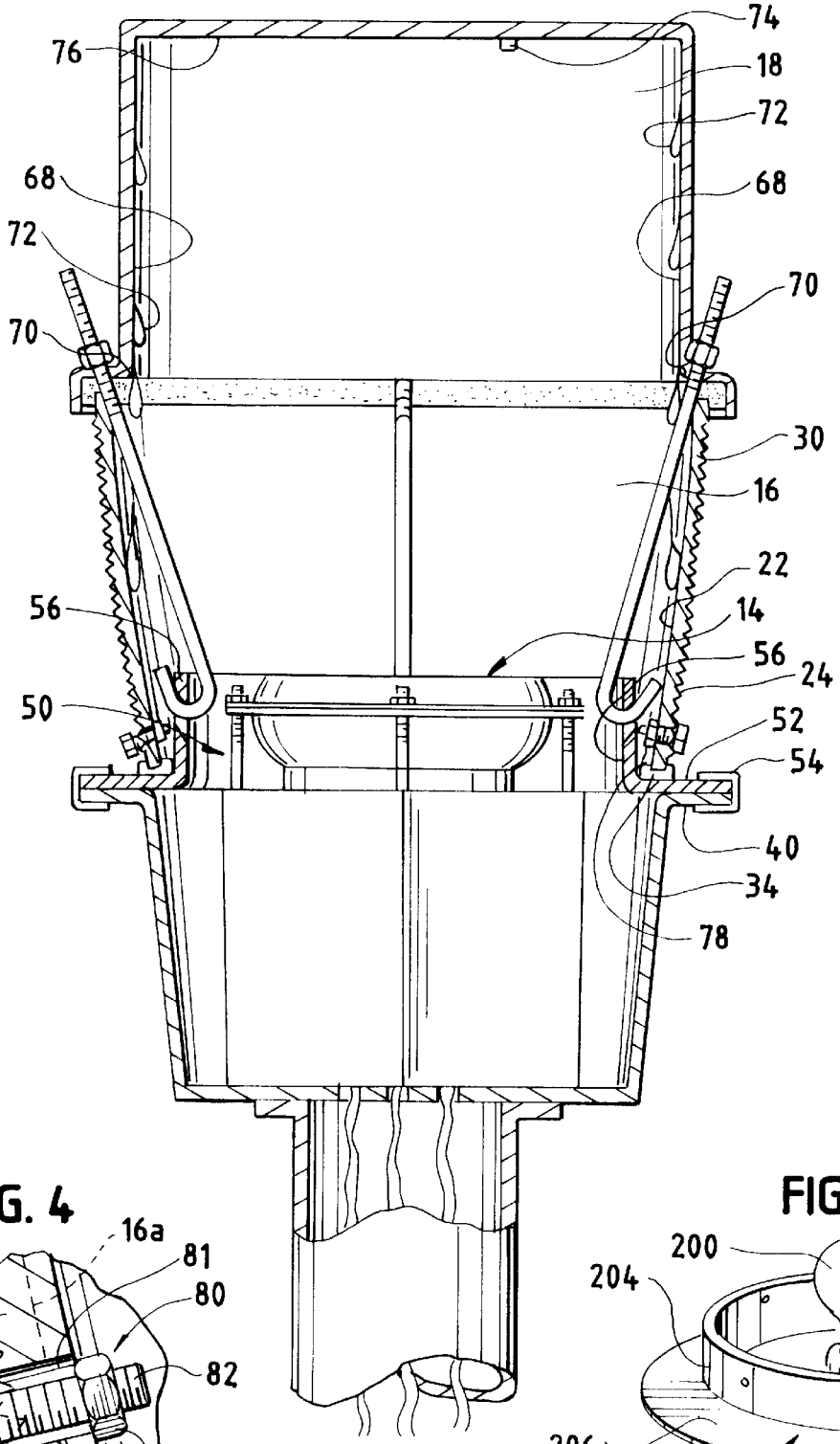
FIG. 3 is a sectional view of a portion of the panoramic light emitter shown in FIG. 1, taken along line 3—3.

As may be more clearly seen in FIG. 3 also, the inside walls 68 of dome member 18 terminate in shoulders 70 at the lower end portions of walls 68 adjacent the upper end 30 of the lens 16. When condensation inside dome 18 collects in droplets 72 on walls 68, shoulders 70 provide means inside the dome member for the condensation to drip onto the sloping sides 22 of the refractor. It can be further seen in FIG. 3 that shoulders 70 are disposed outside the diameter of neck portion 56 of the collar member 50. Condensation droplets 72 therefore fall on to the sloping sides 22, and, at most, only a few droplets, such as 74, which may collect on the ceiling 76 of the dome member 18, will fall inside the neck 56 of the collar 50. Normally ceiling 76 is slightly arched to promote movement of the droplets to the inside walls 68. The lamp 14 and electrical connections 48 are thus protected from dripping condensation.

The dome member 18 may be provided with external fins (not shown) to enhance heat dissipation, and when such a construction is utilized, condensation on the internal walls of the dome may occur at an increased rate.

Figure 4:
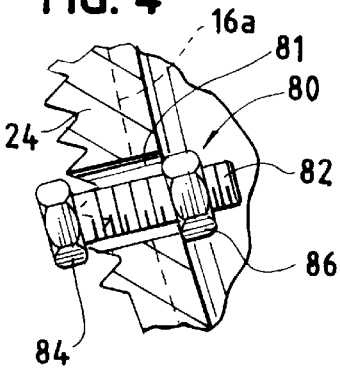
FIG. 4 is an enlarged sectional view, partially broken away, of a portion of the lower lens wall in the light emitter shown in FIG. 1, taken along the line 4—4.

The disposal of accumulated condensation droplets which fall upon walls 22 is accommodated in the following manner as shown in FIGS. 3 and 4. The smaller orifice 26 of lens 16 is seated upon second gasket 34 which in turn rests upon flange portion 52 of the collar 50 outside of the collar neck portion 56. The gasket 34 and lens wall, on one side, and the neck portion 56 of the collar, on the other side, form a trough 78 surrounding the neck portion 56 for the condensation droplets 72 to collect in, following their descent along the sloping sides 22 of the lens. Means 80 are provided in the lower end 24 of the lens to drain accumulated condensation from the trough 78 through the sloping sides 22 of the lens and away from the neck portion 56 of the collar to the outside of the lens.

As shown in the enlarged detail of FIG. 4, drain means 80 is constructed in the following manner. An aperture 81 is formed in the lower end 24 of lens 16. As indicated by dotted line 16A, the inner surface of lens 16 is a series of vertical channels and ridges which form prisms inside the lens, and the line 16A shows the depth of the channels adjacent aperture 81. A bolt 82 having a body portion of substantially smaller diameter than the aperture 81 is disposed in the aperture but head and nut portions 84 and 86, respectively, are sufficiently large enough to prevent the bolt from falling through the aperture. The nut portion 86 touches the peaks of the prisms adjacent aperture 81 and is sufficiently close to them so that the bolt 82 moves easily and slightly in the aperture. When the bolt 82 is assembled in the aperture in this manner, in non-sealing engagement on the lens, condensation travels in the prismatic channels and aperture 81 becomes a weephole for the condensation in trough 78 to flow through from inside the lamp fixture to the outside. Any substantial flow may drip off the outer side of clamping ring 54, although normally the condensation flowing out of the lamp evaporates from the upper surface of flange portion 52. Construction of drain means 80 utilizing a bolt with a head and a nut prevents insects or any substantial quantity of dust from entering the lamp fixture while still providing for easy drainage of accumulated condensation.

Figure 5:
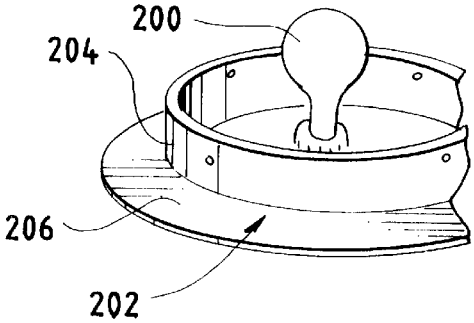
FIG. 5 is a view of an alternative form of light source which is suitable for use in the structure of a light emitter shown in FIGS. 1 through 4.

While the condensation diversion system which is shown in FIGS. 1–4 has been developed especially to improve the lamp fixture shown in the patents identified at the outset hereof, it will be recognized that it may be used with incandescent types of light sources also. Such a construction is illustrated in essence in FIG. 5, wherein an incandescent light source 200 is disposed inside a collar 202 having an upright neck portion 204 and a horizontally disposed flange portion 206. No drainage means such as 80 has been shown in FIG. 5 because the construction of a weephole through the lower areas of lens walls resting on collar 206 would be the same as the construction of means 80 described above.

The foregoing description of a lamp fixture utilizing a dome depicts a construction in which the dome member includes vertical or substantially vertical sides. Alternatively, the lens may be covered with a horizontally arranged cover substantially flatter than a dome. In such an embodiment, condensation formed on the inside of the lens is collected in the trough and is disposed of through the apertures at the base end of the lens as above described.

While particular embodiments of the present invention have been shown, it will be understood, of course, that the invention is not limited thereto since modifications may be made by those skilled in the art, particularly in light of the foregoing teachings. It is, therefore, contemplated by the appended claims to cover any such modifications as incorporate those features which come within the true spirit and scope of the invention.

I claim:

1. A lamp fixture comprising a refractor for receiving light from a source of light and distributing light from the source into a far field, the refractor having sloping sides extending upwardly to form at least one inclined surface from a lower end of the refractor having a smaller orifice to an upper end of the refractor having a larger orifice, a dome member for dispersing heat from inside the refractor disposed upon the upper end of the refractor, the source of light inside and adjacent the lower end of the refractor, a base canister supporting the refractor and the dome member and containing means for supplying current to the source of light, a collar member intermediate the canister and the refractor having a neck portion and a flange portion, the flange portion overlying the canister and outwardly of the neck portion and providing a seat around the neck portion for the lower end of the refractor, the neck portion extending upwardly from the flange portion into the lower end of the refractor and walling off the means for supplying current to the source of light from the sloping sides of the refractor and the flange portion of the collar member, means inside the dome member for condensation collected on an inside surface of the dome member to drip inside the refractor onto the inclined surface of the refractor, and means extending through the sides of the refractor for condensation collected inside and adjacent the lower end of the refractor to flow away from the neck portion of the collar member to outside of the refractor.

2. The lamp fixture of claim 1 which includes a clamp member connected to the dome member holding the dome member upon the upper end of the refractor.

3. The lamp fixture of claim 2 in which the clamp member is engaged in the dome member and in the collar member and is arranged to clamp the refractor between the dome member and the collar member.

4. The lamp fixture of claim 1 in which an inner surface of a roof of the dome member includes surface portions sloping toward side walls of the dome member directing condensate collecting on an inner surface of the dome member to flow onto the dome member side walls.

5. The lamp fixture of claim 1 in which a gasket is clamped in sealing engagement between the dome member and the upper end of the refractor.

6. The lamp fixture of claim 1 in which the neck portion of the collar member is spaced apart from the sloping sides of the lower end of the refractor and forms a trough between the collar member and the refractor sides.

7. The lamp fixture of claim 1 in which the means extending through the sloping sides of the refractor includes a plurality of weep holes formed adjacent the lower orifice of the refractor for conducting condensation from inside the refractor to outside of the refractor.

8. The lamp fixture of claim 7 in which the flange portion of the collar member is arranged adjacent the weep holes in the refractor to receive condensation issuing from the weep holes.

9. The lamp fixture of claim 7 in which the weep holes each contains a loosely fitted bolt having a shank element extending through the weep hole and weep hole covering elements on both ends of the shank element.

10. The lamp fixture of claim 1 in which the flange portion of the collar member and a flange on the upper end of an canister are clamped together to form a horizontal ledge adjacent the lower end of the refractor for conducting condensation away from the refractor and beyond the base canister below the ledge.

11. An electromagnetic radiation receiving fixture comprising a refractor for receiving radiation from a source of radiation in a distributed far field, the refractor having sloping sides extending upwardly to form at least one inclined surface from a lower end of the refractor having a smaller orifice to an upper end of the refractor having a larger orifice, a dome member for dispersing heat from inside the refractor disposed upon the upper end of the refractor, an electromagnetic radiation detecting means inside the refractor, a base canister supporting the refractor and the dome member and containing means for receiving output from the electromagnetic radiation detecting means, a collar member intermediate the canister and the refractor and having a neck portion and a flange portion, the flange portion overlying the canister and outwardly of the neck portion and providing a seat around the neck portion for the lower end of the refractor, the neck portion extending upwardly from the flange portion into the lower end of the refractor and walling off the means for receiving output from the electromagnetic radiation detecting means from the sloping sides of the refractor and the flange portion of the collar member, means inside dome member for condensation on the inside surface of the dome member to drip inside the refractor onto the inclined surface of the refractor, and means extending through the sides of the refractor for condensation collected inside and adjacent the lower end of the refractor to flow away from the neck portion of the collar to the outside of the refractor.

12. A lamp fixture comprising a refractor for receiving light from a source of light and distributing light from the source into a far field, the refractor having vertically disposed sides forming at least one surface inside the refractor and extending substantially from a lower end of the refractor to an upper end of the refractor, a cover member disposed upon the upper end of the refractor, the source of light inside the refractor, a base canister supporting the refractor and containing means for supplying current to the source of light, a collar member intermediate the canister and the refractor and having a neck portion and a flange portion, the flange portion overlying the canister and outwardly of the neck portion and providing a seat around the neck portion for the lower end of the refractor, and the neck portion extending upwardly from the flange portion into the lower end of the refractor and walling off the means for supplying current to the source of light from the sides of the refractor and the flange portion of the collar member, means for conducting condensation collected on the cover member to the inside surface of the refractor, and means extending through the sides of the refractor for condensation collected inside and adjacent the lower end of the refractor to flow away from the neck portion of the collar member to outside of the refractor.

13. A lamp fixture comprising a refractor having an upper end and a lower end and receiving light from a source of light and distributing light from the source into a far field, the source of light inside the refractor, a dome member made of electrically conductive material for dispersing heat from inside the refractor disposed upon the upper end of the refractor, a base canister electrically connected to ground supporting the refractor and the dome member and containing means for supplying current to the source of light, a collar member intermediate the canister and the refractor and having a neck portion and a flange portion, the flange portion overlying the canister and outwardly of the neck portion and providing a seat around the neck portion for the lower end of the refractor, and the neck portion extending upwardly from the flange portion into the lower end of the refractor, an electrically conductive clamp member attached to the dome member and the collar member clamping the refractor between the dome member and the collar member and electrically connecting the dome member and the collar member, and an electrically conductive connection member affixed to the collar member and the base canister, thereby connecting the dome member electrically to ground.

* * * * *